US005247780A

United States Patent [19]

Kulpa et al.

[11] Patent Number: 5,247,780

[45] Date of Patent: Sep. 28, 1993

[54] ROTATING ENVELOPE OPENING FINGER

[75] Inventors: Walter J. Kulpa, Trumbull; William D. Toth, Milford, both of Conn.

[73] Assignee: Pitney Bowes Inc., Stamford, Conn.

[21] Appl. No.: 37,842

[22] Filed: Mar. 29, 1993

[51] Int. Cl.[5] ..... B65B 43/26; B65B 43/30; B65B 39/02

[52] U.S. Cl. ..... 53/381.5; 53/381.6; 53/569

[58] Field of Search ..... 53/381.5, 381.6, 255, 53/261, 572, 569

[56] References Cited

U.S. PATENT DOCUMENTS

| | | | |
|---|---|---|---|
| 3,618,292 | 12/1969 | Rademacher | 53/261 X |
| 4,377,929 | 3/1983 | Altenpohl et al. | 53/572 |
| 4,432,188 | 2/1984 | Andrews | 53/572 X |
| 4,494,364 | 1/1985 | Meyn | 53/572 X |
| 4,781,013 | 11/1988 | Depasquale et al. | 53/255 X |
| 4,805,381 | 2/1989 | Hannon | 53/572 X |
| 5,125,214 | 6/1992 | Orsinger et al. | 53/381.6 X |
| 5,168,689 | 12/1992 | Macelis | 53/381.5 X |

*Primary Examiner*—Horace M. Culver
*Attorney, Agent, or Firm*—Charles R. Malandra, Jr.; Melvin J. Scolnick

[57] ABSTRACT

A rotatable guide finger for opening an envelope prior to insertion of documents into the envelope. The finger includes a pivotable arm and a sidewall defining a channel. The sidewall extends downstream from the pivotable arm and has an upper and a lower sidewall portion, each of the sidewall portions including an arc having a radius of about 0.16 inches and a line at an angle of about fifty degrees to a horizontal radius to the arc.

4 Claims, 5 Drawing Sheets 10
12
26
28
30
32
36
37
38
40
42
44

ROTATING ENVELOPE OPENING FINGER

BACKGROUND OF THE INVENTION

The instant invention relates to apparatus for inserting documents into envelopes, and more particularly to "fingers" that are used to hold the envelope open during the time that the documents are inserted into the envelope.

Inserting machines typically feed and collate a plurality of enclosures and then insert the collated enclosures into a waiting envelope. Inserting machines are used with a wide range of enclosure thicknesses and also with enclosures which are not significantly different in length than the length of the envelopes into which they are inserted. The difference between the length of the enclosures and the envelope should be minimized so that the addressing information printed on the enclosures which is intended to appear in the envelope window does not shift in position and become hidden. Guide fingers for opening an envelope are known which rotate into the envelope after the envelope has been properly located. However, conventional, rotating guide fingers typically require operator intervention in order to accommodate a range of enclosure thicknesses and envelope depths. Obviously, operator intervention is costly in terms of down time of the inserter and the effort required on the part of the operator.

The instant invention provides rotating guide fingers which open an envelope and are so shaped that they can accommodate a range of envelope depths and enclosure thicknesses without the need for an operator to intervene to adjust any of the inserter apparatus, and which can open envelopes which are not significantly longer in length than the enclosures to be inserted therein.

SUMMARY OF THE INVENTION

Accordingly, the instant invention provides a rotatable guide finger for opening an envelope prior to insertion of documents into the envelope. The finger includes a pivotable arm and a sidewall defining a channel. The sidewall extends downstream from the pivotable arm and has an upper and a lower sidewall portion, each of the sidewall portions including an arc having a radius of about 0.16 inches and a line at an angle of about fifty degrees to a horizontal radius to the arc.

DETAILED DESCRIPTION OF THE PREFERRED EMBODIMENT

Figure 1:
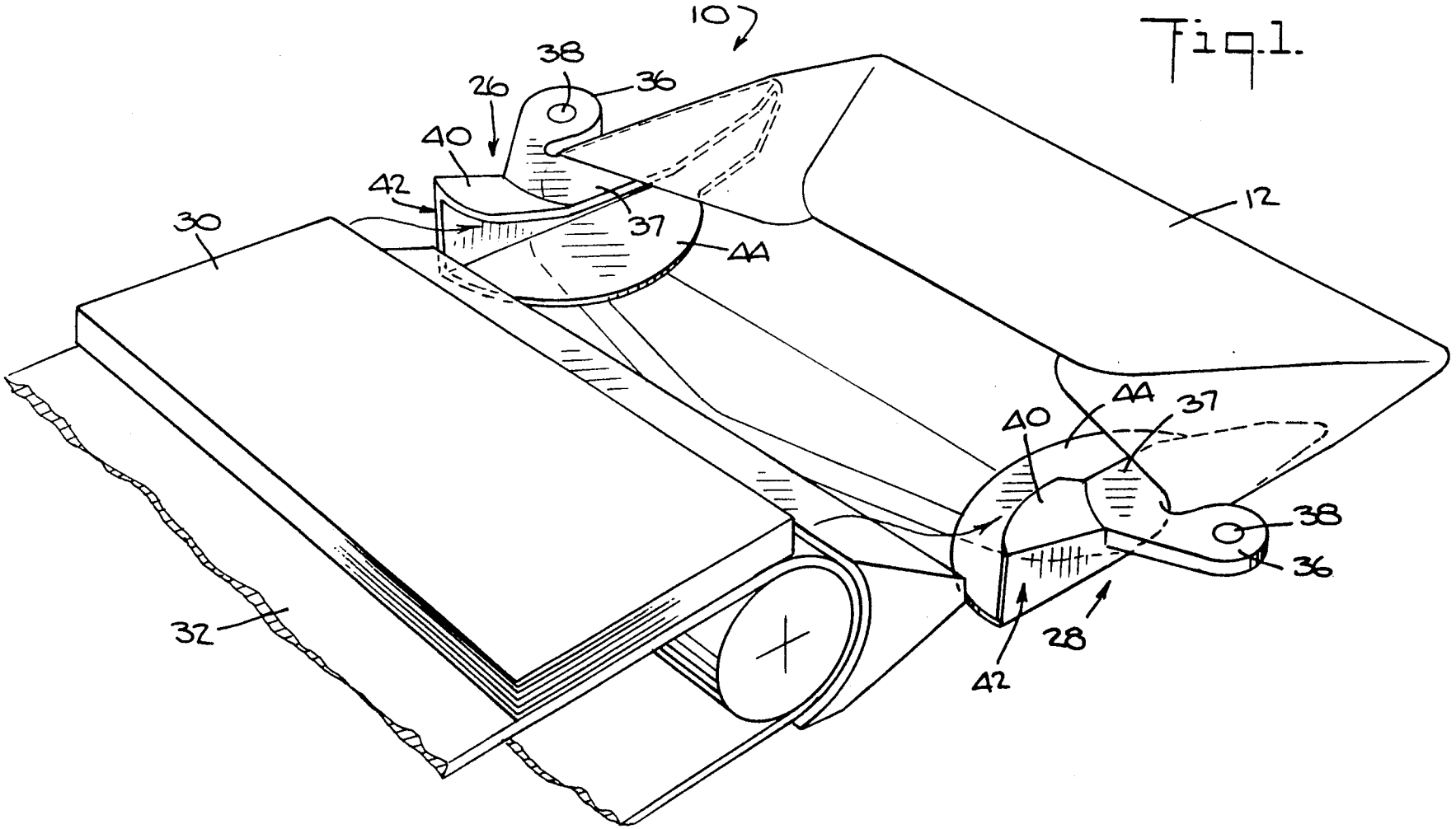
FIG. 1 is a perspective view of an envelope being opened by guide fingers in accordance with the instant invention.
Figure 2:
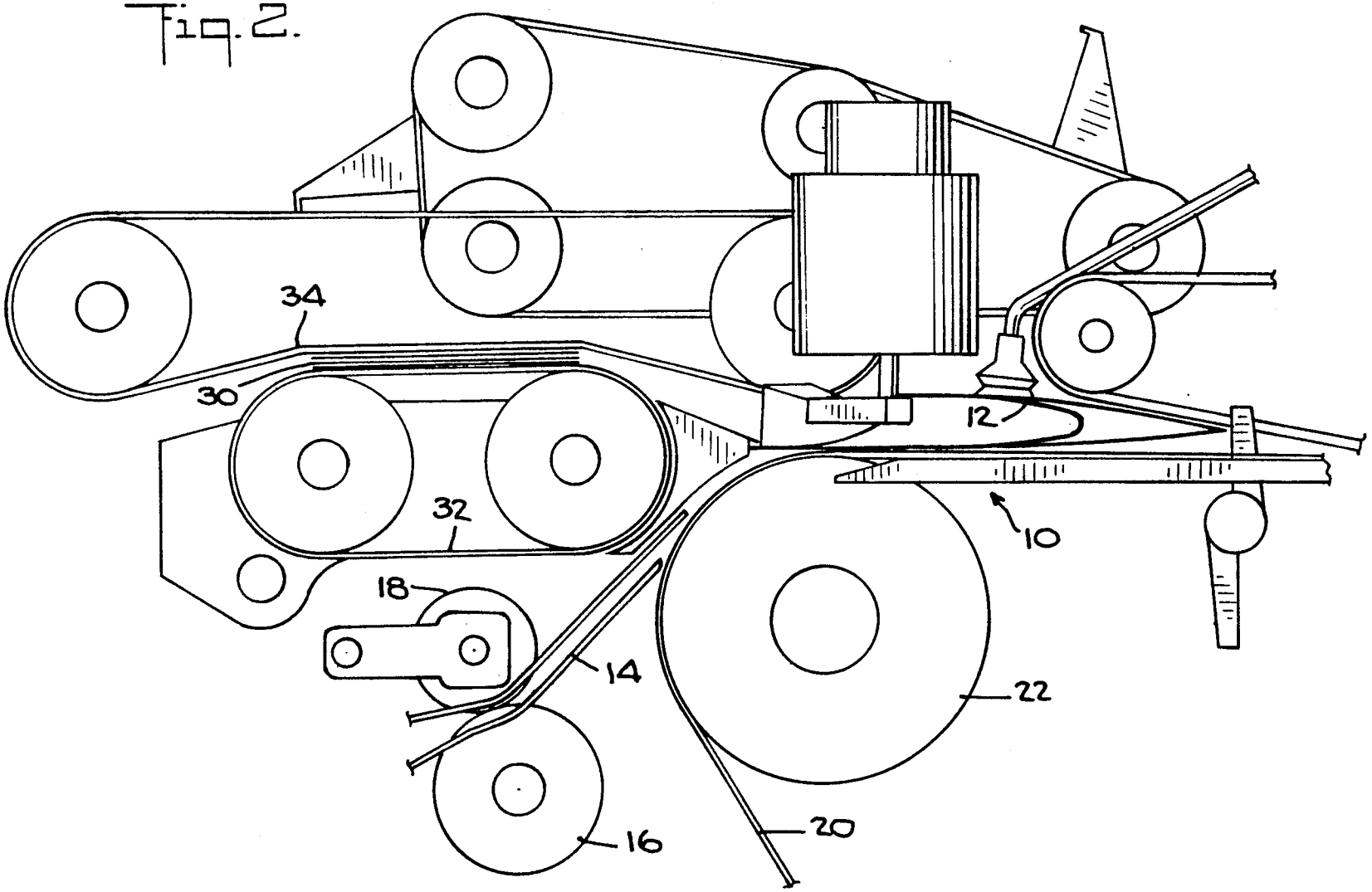
FIG. 2 is a side, elevational view of an envelope inserting apparatus using the guide fingers seen in FIG. 1.
Figure 3:
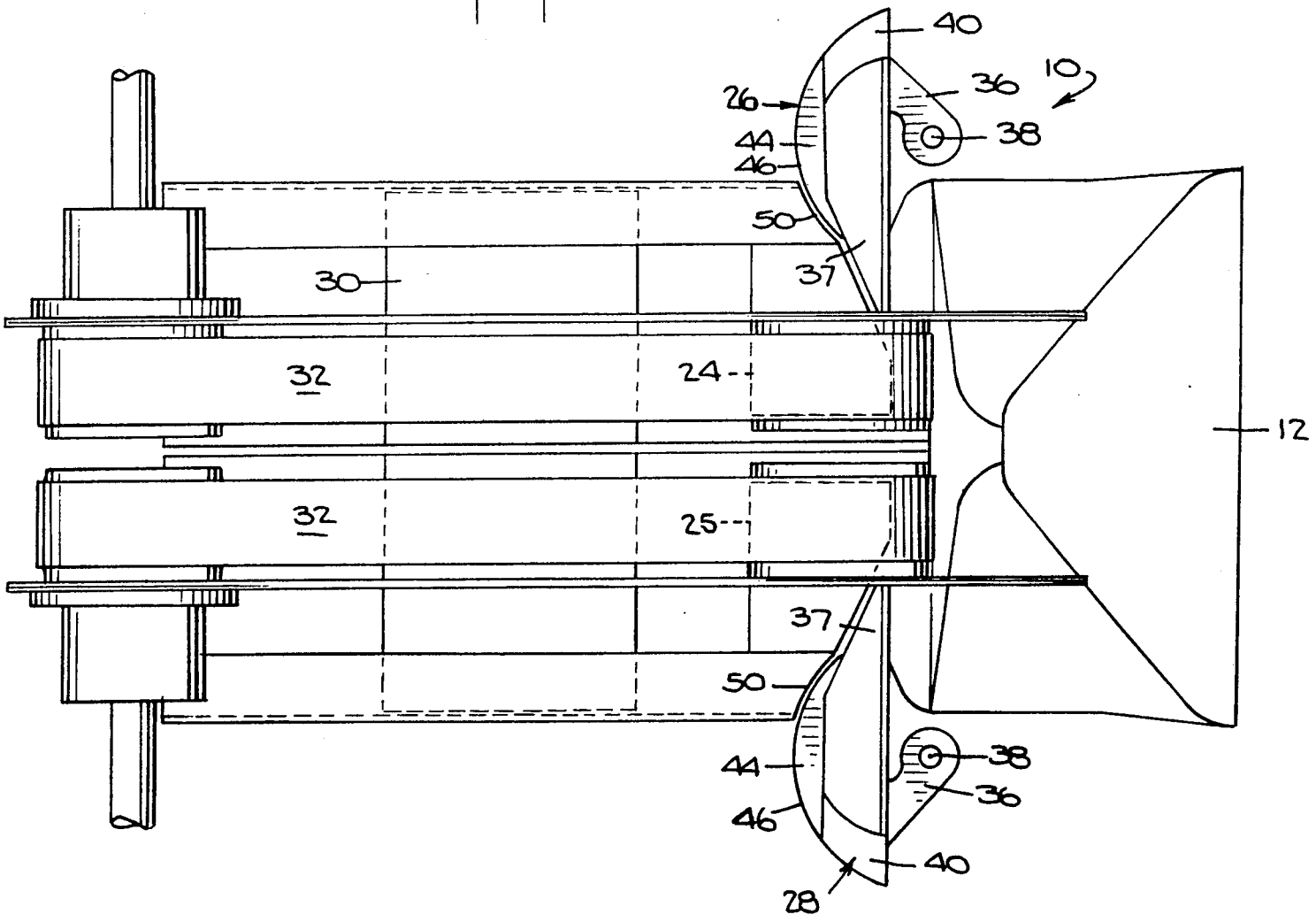
FIG. 3 is a top, plan view of the apparatus seen in FIG. 1 but shows the guide fingers about to enter the envelope.

In describing the instant invention, reference is made to the drawings, wherein there is seen in FIG. 2 an envelope inserting station generally designated 10 which is the last station of an inserting machine whose other stations (not shown) are located upstream of the inserting station 10. An envelope 12 enters the insertion station 10 along an angled guide 14 and is transported into the insertion station 10 by a set of arming rollers 16 and 18 and a vacuum transport belt 20 which wraps around a vacuum drum 22. Since the leading edge of the envelope 12 cannot be made to conform to the vacuum drum 22, the underside of the envelope flap retainers 24 and 25 (see FIG. 3) and the underside of the guide fingers 26 and 28 must assist in helping the envelope conform to the vacuum drum 22 and must not present any catch points for the leading edge of the enclosure collation 30 (see FIG. 2).

The enclosure collation 30 are fed downward to the insertion station 10 by means of a pair of elastic transport belts 32 and a pair of mating elastic belts 34. As with the envelope 12, the top side of the envelope flap retainers 24 and 25 and the associated interior of the guide fingers 26 must not present any catch points for the leading edge of the enclosure collation 30.

Figure 6:
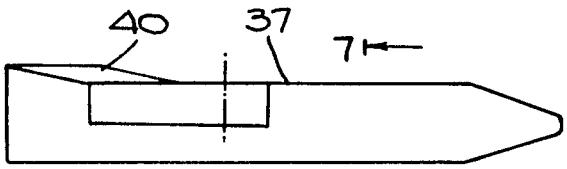
FIG. 6 is a front elevational view of the finger seen in FIG. 5.
Figure 5:
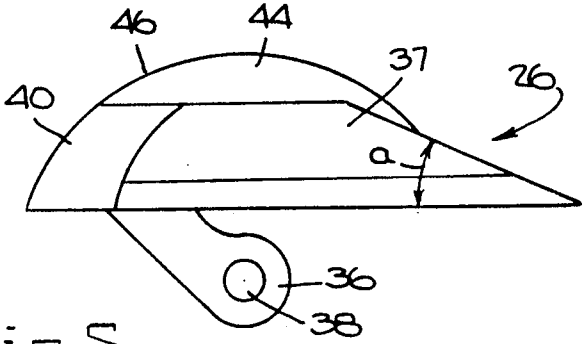
FIG. 5 is a top, plan view of the guide finger seen in FIG. 1.
Figure 8:
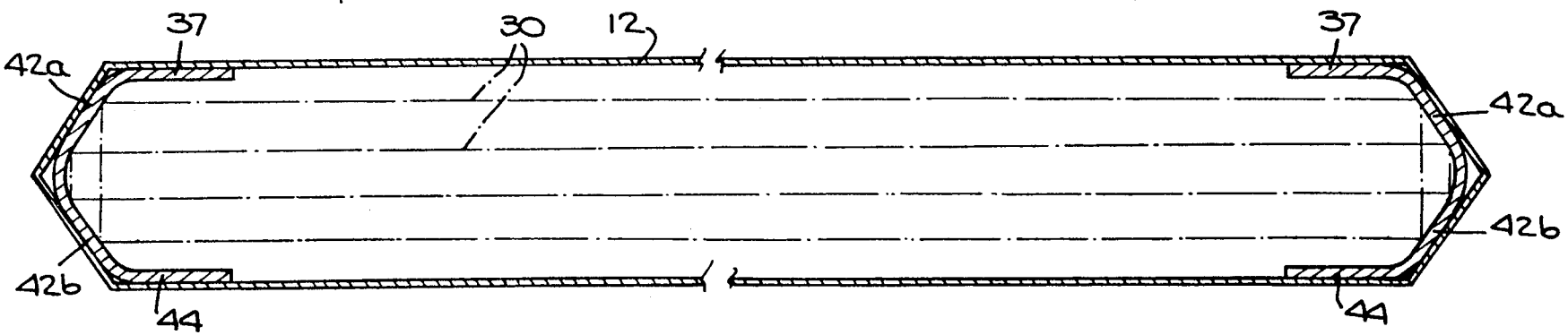
FIG. 8 is a vertical, sectional view of an envelope as it is opened by the guide fingers within.

As best seen in FIGS. 5 and 6, each guide finger 26 includes a pivotable arm 36 having an aperture 38 which functions as a pivot point. Each arm 36 connects to a top, horizontal plate portion 38 of the finger 26. Angled upwardly from the plate portion 38 is a flange 40. The plate portion 38 and flange 40 lead to a channel side wall 42 having the configuration seen in FIG. 7 and described in detail hereinbelow. The side wall 42 merges into a bottom, horizontal plate portion 44.

Figure 4:
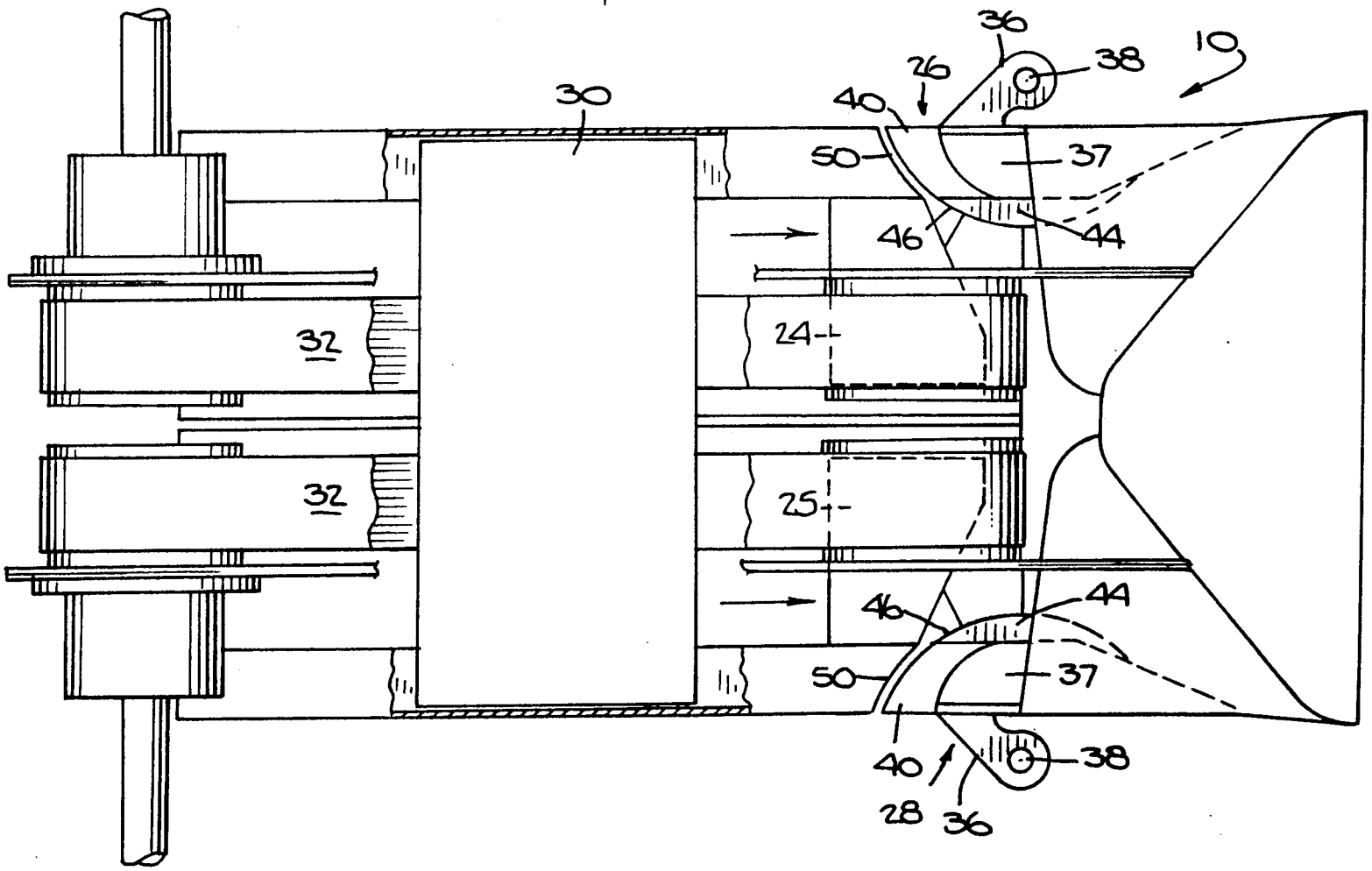
FIG. 4 is similar to FIG. 3 but shows the guide fingers within the envelope and a collation of inserts about to be inserted into the opened envelope.

As seen in FIG. 5, the downstream ends of the top and bottom plate portions 38 and 44 form an acute angle a with the length of the channel side wall 42. The upstream end of the bottom plate portion 44 takes on a flat, circular surface 46 (see FIGS. 3 and 4) so that there is only a minimal gap between the envelope flap retainers 24 and 25 and the guide fingers 26 when the latter are moved to their envelope shaping position seen in FIG. 4. Moreover, the shape of this gap avoids presenting any surfaces on which a leading edge could stub.

Figure 7:
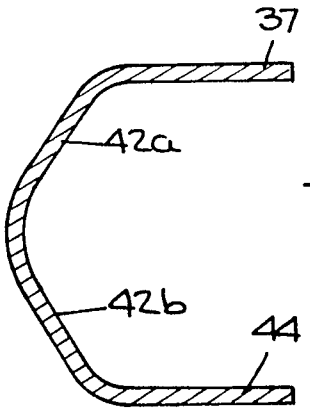
FIG. 7 is a sectional view taken on the plane indicated by the line 7—7 in FIG. 6.

In order to produce a shape at the upstream end of the guide finger 26 which approximates the pillow-like shape of the bottom of an opened envelope 12, the cross section of the finger 26, seen in FIG. 7, must be cut at an angle as discussed above. In a preferred embodiment, the acute angle a is about 24 degrees.

The flared surface 46 of the guide finger 26 is shaped in a circular manner to interface with the enclosure guide 50 with a minimal gap to also avoid stubbing of a leading edge of enclosures. See FIGS. 3 and 4.

The shape of the cross-section of the downstream end of the guide finger 26, as seen in FIG. 7, is critical to the working of the insertion station 10 and its ability to process a range of envelope depths and enclosure thicknesses without the need for an operator to intervene to make any adjustments. Specifically, the downstream end of the guide finger is defined by the side wall 42, which has an upper portion **42*a* and a lower portion 42*b*. The shape of the side wall portion 42*a*** can be described substantially by the equation $y=x^2-9.5x+22.5$. An acceptable approximation to this equation is given by the tangential intersection of the following: an arc having a radius of 0.16 inches, and a line at an angle of 50 degrees to a horizontal radius to the arc.

From the foregoing description, it can be seen that the guide fingers 26 are so shaped that they can accommodate a range of envelope depths and enclosure thicknesses without the need for an operator to intervene to adjust any of the inserting apparatus, and that the fingers 26 can open envelopes which are not significantly longer in length than the enclosures to be inserted therein.

It should be understood by those skilled in the art that various modifications may be made in the present invention without departing from the spirit and scope thereof, as described in the specification and defined in the appended claims.

What is claimed is:

1. A rotatable guide finger for opening an envelope prior to insertion of documents into the envelope, comprising:

a pivotable arm; and a sidewall defining a channel, said sidewall extending downstream from said pivotable arm and having an upper and a lower sidewall portion, each of said sidewall portions including an arc having a radius of about 0.16 inches and a line at an angle of about fifty degrees to a horizontal radius to said arc.

2. The guide finger of claim 1, wherein said guide finger additionally includes a top, horizontal plate portion extending from said pivotable arm.

3. The guide finger of claim 2, wherein said guide finger additionally includes a flange angled upwardly from said top, horizontal plate portion, and wherein said plate portion and said flange lead to said channel side wall.

4. The guide finger of claim 3, wherein said guide finger additionally includes a bottom, horizontal plate portion extending from said sidewall.

* * * * *